US012030595B2

(12) United States Patent
Wilmoth, III

(10) Patent No.: US 12,030,595 B2
(45) Date of Patent: Jul. 9, 2024

(54) FOLDABLE WATER FLOW DEFLECTION DEVICE AND METHODS OF USE

(71) Applicant: Robert H. Wilmoth, III, Louisburg, NC (US)

(72) Inventor: Robert H. Wilmoth, III, Louisburg, NC (US)

(73) Assignee: Robert H. Wilmoth, III, Louisburg, NC (US)

( * ) Notice: Subject to any disclaimer, the term of this patent is extended or adjusted under 35 U.S.C. 154(b) by 341 days.

(21) Appl. No.: 17/443,577

(22) Filed: Jul. 27, 2021

(65) Prior Publication Data

US 2023/0036601 A1 Feb. 2, 2023

Related U.S. Application Data

(60) Provisional application No. 63/222,843, filed on Jul. 16, 2021.

(51) Int. Cl.
*B63B 34/75* (2020.01)

(52) U.S. Cl.
CPC ..... *B63B 34/75* (2020.02); *B63B 2221/22* (2013.01)

(58) Field of Classification Search
CPC ..... B63B 34/75; B63B 2221/22
See application file for complete search history.

(56) References Cited

U.S. PATENT DOCUMENTS 4,752,259 A * 6/1988 Tackett ..... A63B 31/11 D21/806
9,834,280 B1 * 12/2017 Wilmoth, III ..... B63B 1/32
2021/0371056 A1 * 12/2021 Watkins ..... B63B 3/48

* cited by examiner

*Primary Examiner* — Stephen P Avila
(74) *Attorney, Agent, or Firm* — DeWitt LLP

(57) ABSTRACT

A water flow deflection device configured to be attached to a side of a watercraft for wake enhancement, the water flow deflection device having a water flow deflector having a stationary portion operably connected to a foldable portion, the foldable portion capable of being configured between a fully extended position and a folded position with intermediate folding positions there between, whereby the foldable portion in the folded position is configured to facilitate storage of the device. The water flow deflection device also includes a frame connected to the stationary portion of the water flow deflector, the frame including a base, at least one extension arm, and two or more suction cups for attaching the water flow deflection device to the side of the boat.

20 Claims, 15 Drawing Sheets

FOLDABLE WATER FLOW DEFLECTION DEVICE AND METHODS OF USE

TECHNICAL FIELD

The present invention relates generally to watercraft accessories and wake shaping, in particular a water flow deflection device for a watercraft that can form a desirable wake, even more particularly a water flow deflector of the device having at least one portion moveable between an extended position and a folded position, such that the extended position enhances the surface area of the water flow deflector and the folded position facilitates storage of the device.

BACKGROUND

The sport of wake surfing, performing surfing maneuvers on a surfboard in the wake of a boat without using a tow rope, has become popular among water sports and boating enthusiasts. Wake surfing is similar to surfing on natural ocean waves, except it is performed on the waves formed behind a moving boat. However, wake surfing is limited to boats capable of providing good surfable waves at a safe distance behind the boat. Wake surfing requires a large wake pattern to enable the rider to perform surfing maneuvers. New boats have been equipped with various systems to generate the surfable wake. However, the creation of sufficiently large, steep, surfable quality waves using older conventional ski boats is difficult and potentially dangerous for the wake surfer, the boat, and passengers.

Conventional water ski boats are not designed to make waves but, rather, to minimize them in order to minimize power requirements and to provide the smooth wake patterns that high speed skiing requires. Thus, the goal of conventional ski boat designs are to lessen displacement, decrease drag, and enable the boat to travel faster with less energy.

In order to generate an increase in wake size, wakeboarders have attempted to overcome the design objectives of conventional water ski boats by adding heavy, static ballast to the boat. Such ballast is usually in the form of water filled bags, concrete blocks, or other such weighted objects that disadvantageously occupy inboard passenger space. One other significant disadvantage to static ballast is that it can easily lead to an unsafe overload condition for the boat and passengers.

Ballasted boats for wakeboarding will not necessarily create wakes with surfable quality at normal speeds. Therefore, creating a surfable wave with a conventional ski boat typically involves a reduction in speed to less than 15 mph along with the addition of ballast to the boat. At such speeds and weights, the waves created by the boat are typically within a few feet of the boat's transom, as well as the exhaust and propeller. This makes wake surfing using conventional ski boats difficult to perform, unhealthy, and potentially dangerous.

Thus, there is a need in the art for aftermarket adaptability of boats for wake surfing. There is a further need in the art for adjustability in aftermarket devices to provide maximum wake with minimal boat modification. There is a further need in the art to maximize the hydrodynamics of such aftermarket devices while minimizing the space of such aftermarket devices onboard a boat when the device is not being utilized.

SUMMARY

The present application is directed to a water flow deflection device configured to be attached to a side of a watercraft, preferably the hull of a watercraft, such as a boat. In certain aspects of the present invention, the water flow deflection device has a deflector having a first section and second section, whereby the second section is foldable with respect to the first section, such that the deflector is capable of being adjusted between a fully extended position and a folded position. In some aspects, the deflector is adjusted to the fully extended position during normal operation, such that the deflector in the fully extended position operably engages with oncoming water to enhance the water flow deflection as the watercraft moves through the water and thereby enhancement of wake formation behind the watercraft. In some aspects, the deflector is adjusted to the folded position for storage, such as when the device is removed from the side of the watercraft. In some aspects, the deflector is capable of being positioned at an intermediate position during normal operation, whereby the second section is adjusted to a position between the fully extended position and the folded the position, such that the deflector in the intermediate position operably engages with oncoming water to enhance the water flow deflection as the watercraft moves through the water and thereby enhancement of wake formation behind the watercraft.

In certain aspects, the first section and second section are operably attached by one or more hinges. In certain preferred aspects, the first section has a distal end that operably engages with a proximate end of the second section to form an integral hinge, wherein the integral hinge is capable of having one or more rods running through a longitudinal axis of the integral hinge.

In certain aspects, the first section and second section are locked into the fully extended position by a fastening means. In certain preferred aspects, the fastening means is a quick release skewer assembly or one or more bars.

In some preferred aspects, the fastening means is the quick release skewer assembly comprising a rod threaded on one end that is operably inserted through the apertures of the hinge in the longitudinal axis and a lever operated cam assembly on the other end, whereby an adjustment nut operably engages the threaded end at an opposite end of the cam assembly, and optionally two or more conical springs. In certain aspects, the conical springs press against the ends of the hinge and are compressed as the lever assembly is tightened with respect to the adjustment nut.

In certain aspects, the first section and second section are locked into the intermediate position by the quick release skewer assembly.

In certain aspects, the first section and second section are locked into the fully extended position by one or more bars proximately located a backside of the deflector, wherein the one or more bars can be slidably adjusted from an unlocked position to a locked position, such that the second section is incapable of folding during normal operation when oncoming water operably engages the deflector.

In certain aspects, the water flow deflection device includes a frame with an elongated base with a first end and a second end with the base configured to be aligned along the side of the watercraft when the water flow deflection device is attached to the side of the watercraft. In some aspects, the frame includes an extension arm attached to and extending outwardly from the base and having a first end and a second end. The extension arm extends away from the side of the watercraft when the water flow deflection device is attached to the side of the watercraft. The frame also includes at least two suction cups attached to the elongated base, wherein a first suction cup is attached to the elongated base proximate the first end and a second suction cup is attached to the elongated base proximate the second end. The water flow deflection device also includes a water flow deflector attached to the extension arm and being aligned at an acute angle relative to the base. The deflector includes an enlarged surface area configured to deflect water with a leading end that is positioned outward in front of the base and a trailing end opposing the leading end. The leading end is in closer proximity to the watercraft than the trailing end when the deflector is attached to the watercraft.

In certain aspects, the deflector includes an extension section operably connected to the second section of the deflector, such that the extension and second sections that are movable relative to each other to adjust the distance between the leading end and the trailing end. The device also includes a support that extends between and connects the deflector to the extension arm. In certain aspects, the support is configured to adjust the angle of the deflector relative to the extension arm, such that the acute angle relative to the base can be adjusted.

The water flow deflection device may include a central section of the deflector between the leading and trailing ends attached to the first end of the extension arm.

In certain aspects, the extension section and the first section of the deflector may be in an overlapping configuration with a first portion of the extension section overlapping with a second portion of the first section.

In certain alternative aspects, the extension section of the deflector may be positioned within the second section and may be extendable from within the second section.

The base may include first and second elongated members that are arranged in a side-by-side arrangement with the first member being parallel to the second member and the extension arm may be connected to at least one of the elongated members.

The water flow deflection device may be buoyant causing the water flow deflection device to float in water when detached from the boat.

The frame may include a fourth extension arm and may have a first end attached to the base and an opposing second end with a third suction cup. The fourth extension arm may be angularly adjustable relative to the base to position the third suction cup at a desired location relative to the base.

The second end of the base may be connected to the second end of the fourth extension arm.

Another embodiment is directed to a water flow deflection device and includes a frame with an elongated base, an extension arm with a second end attached to the base and a first end positioned away from the base, and suction cups movably connected to the base. The device also includes a water flow deflector attached to the first end of the extension arm. The deflector includes a surface having a length and a width and having a leading end that is positioned in front of the second end of the base and an opposing trailing end positioned over the base. The deflector includes first and second sections that are in an overlapping arrangement and movable relative to each other to adjust a length of the deflector and an exposed surface area formed by exposed portions of the first and second sections. The device also includes an adjustable support that extends between and connects the deflector to the extension. The support is configured to adjust the angle of the deflector relative to the base.

The deflector may be adjustable over a range of acute angles relative to the base.

The first section of the water flow deflector may be fixedly connected to the extension arm and the second section is movable relative to the first section.

The first section of the water flow deflector may include a pocket formed between front and back sections with the pocket being sized to receive a portion of the second section of the water flow deflector.

The water flow deflection device may be buoyant.

The water flow deflection device may include a third extension arm that is movably connected to the base between the first and second ends and may include a third one of the suction cups.

Another embodiment is directed to a method of using a water flow deflection device to deflect water away from a side of a watercraft. The method includes: attaching suction cups of a water flow deflection device to the side of the watercraft such that the water flow deflection device is attached to the side of the watercraft with the water flow deflector aligned at an acute angle relative to the side of the watercraft; adjustably locking a second section of an exposed surface area of the water flow deflector relative to a first section of the water flow deflector to provide a desired deflector configuration; optionally adjusting an extension section of an exposed surface area of the water flow deflector relative to the second section by moving the extension section of the water flow deflector relative to the second section and adjusting a size of the exposed surface area by changing an amount of overlap between the extension and second sections; optionally fixing the size of the exposed surface area by fixedly positioning the extension section relative to the second section; and optionally adjusting an angle of the water flow deflector relative to the side of the watercraft.

The method may also include adjustably locking the second section relative to the first section prior to attaching the water flow deflection device to the watercraft.

The method may also include adjusting the exposed surface area of the water flow deflector prior to attaching the water flow deflection device to the watercraft.

The method may include adjusting the angle of the water flow deflector relative to a base member prior to attaching the water flow deflection device to the watercraft.

The method may include adjusting a distance between the suction cups that are affixed to an elongated base such that the distance is equal to the distance between selected portions of the side of the watercraft The method may include adjusting the first and second sections of the water flow deflector by sliding the extension section relative to the second section with the extension and second sections being in at least a partially overlapping configuration. In some aspects, the extension section may also partially overlap with the first section.

The various aspects of the various embodiments may be used alone or in any combination, as is desired. Of course, the present disclosure is not limited to the above features and advantages. Indeed, those skilled in the art will recognize additional features and advantages upon reading the following detailed description, and upon viewing the accompanying drawings.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures, in which.

Figure 1:
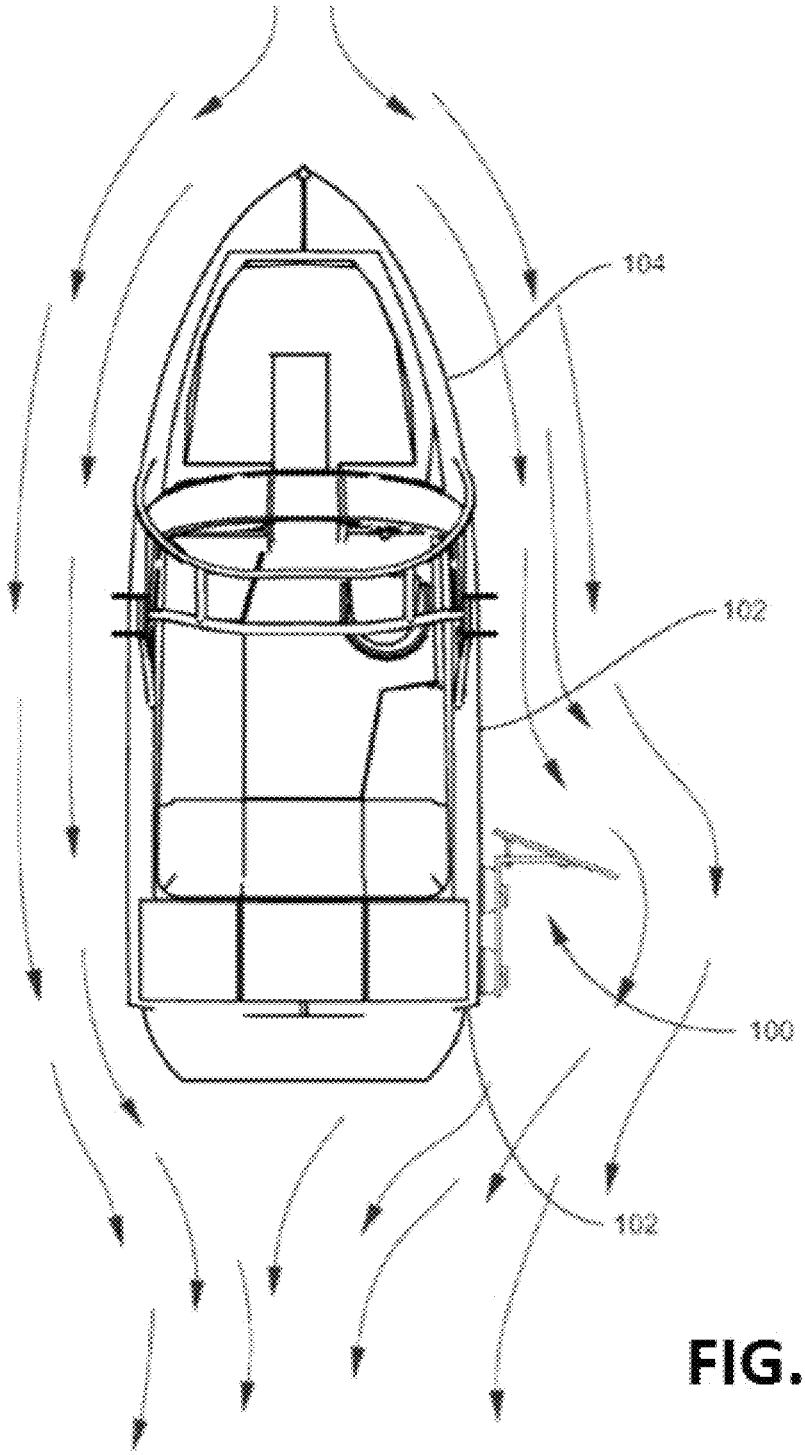
FIG. 1 is a schematic of a water flow deflection device attached to a side of a watercraft, according to certain embodiments of the present invention.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF THE DRAWINGS

The present application is directed to a water flow deflection device 100 configured to be attached to a side 102 of a watercraft 104 for wake enhancement. The water flow deflection device 100 can be attached to either side of the watercraft 104 to divert oncoming water as the watercraft 104 is moving forward. A water flow deflector 112 on the device 100 can be adjusted from a stored position to an operating position, such as a fully extended position or an intermediate position between the fully extended position and the stored position, to create the desired wake. The water flow deflector 112 may optionally be adjusted to a desired surface area size and/or desired angular position relative to the watercraft to further adjust the created wake.

Referring now to the figures, FIG. 1 illustrates a water flow deflection device 100 attached to a side 102 of a watercraft 104. As the watercraft 104 moves through the water, the water flow deflection device 100 redirects the flow of water outward and away from the side 102 of the watercraft 104. However, a vacuum is created in the water as the watercraft 104 moves forward. This vacuum draws the redirected flow of water back behind the watercraft 104 colliding with the flow of water from the opposing side of the watercraft 104. By redirecting the water away from the watercraft 104, the angle at which this redirected flow of water is drawn back behind the watercraft is altered. The redirected flow of water pushes up or enhances the flow of water from the opposing side of the watercraft 104 when the two flows merge back together behind the watercraft 104.

Figure 2A:
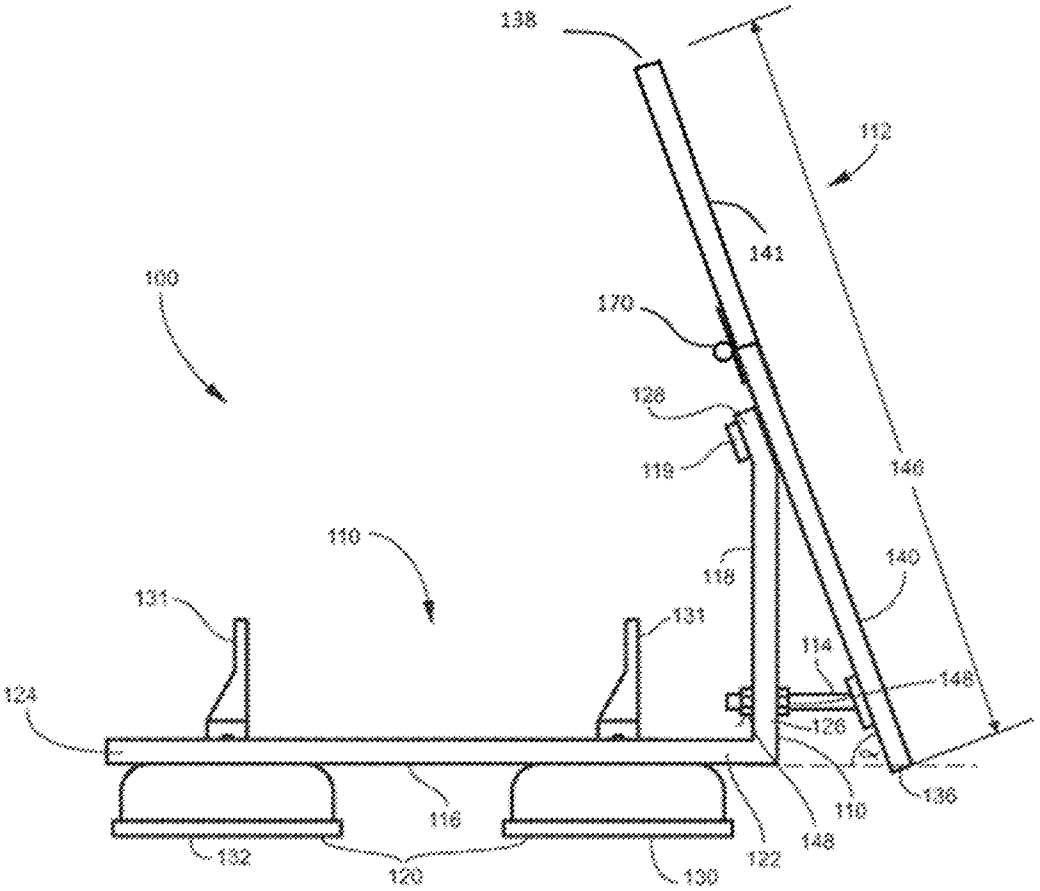
FIG. 2A is a side view of a water flow deflection device to be attached to the side of a watercraft, the water flow deflector in a fully extended position, according to certain embodiments of the present invention.

Referring now generally to FIG. 2A to FIG. 4, the water flow deflection device 100 includes a frame 110, a water flow deflector 112, and an adjustable support 114. The frame 110 includes an elongated base 116 operably connected to an extension arm 118, and two or more suction cups 120 proximately located the elongated base 116. The elongated base 116 includes a first end 122 and a second end 124. The extension arm 118 has a first end 126 and a second end 128. The base 116 extends along the side 102 of the watercraft 104 in a substantially parallel configuration and the extension arm 118 extends away from the side 102 of the watercraft 104 when the water flow deflection device 100 is attached to the watercraft 104. The base 116 and arm 118 may be formed from a single integral piece as illustrated in FIGS. 2A and 2B, or may be constructed from two or more different pieces. In multiple-piece embodiments, the first ends 122, 126 may be in contact or spaced away from each other. In multiple-piece embodiments, the extension arm 118 may be attached to the base 116 in various manners including but not limited to welding, friction fit, and mechanical fasteners.

The extension arm 118 extends away from the base 116 in an approximately 90 degree angle. While the angle that the extension arm 118 extends away from the base 116 is illustrated as approximately 90 degrees, the extension arm 118 may also be positioned at different angular orientations relative to the base 116. A top portion of the extension arm 118 in proximity to the second end 128 may be bent at an angle relative to a remainder of the arm 118. This configuration provides a surface for supporting the deflector 112 as will be explained below.

The extension arm 118 and base 116 may be constructed from a variety of different material, including but not limited to High-density polyethylene (HDPE) and Low-density polyethylene (LDPE). The base 116 and arm 118 may be constructed from the same or different materials. In one embodiment, the arms 116, 118 are constructed from a buoyant material that causes the water flow deflector device 100 to float when in the water and detached from the boat 104.

One or more suction cups 120 are attached to the base 116 to attach the device 100 to the watercraft 104. Any number of suction cups may be used, as illustrated in the various figures. In certain preferred aspects, the device 100 utilizes two suction cups 120. In certain preferred aspects, a first suction cup 130 is attached to the base 116 proximate to the first end 122, and a second suction cup 132 is attached to the base 116 proximate to the second end 124. The suction cups 120 may be attached to the elongated base 116 in a variety of different manners. For example, the suction cups 120 may be attached using a mechanical fastener such as a screw or bolt, may fit within slots/rails formed along the base 116, or may be integrally formed with the base 116. The suction cups 120 may be equipped with a release lever 131 to selectively secure and remove the suction cups 120 from the side 102 of the boat 104. The suction cups 120 may have various sizes. In some embodiments, the suction cups 120 have a diameter of between 1 and 6 inches to have sufficient suction to hold the water flow deflection device 100 against the side 102 of the boat 104 while the boat is moving through the water.

The water flow deflector 112 is generally attached to the extension arm 118. In certain preferred aspects, the first section 140 of deflector 112 is attached at the second end 128 of extension arm 118 as illustrated in FIGS. 2A-2B, 2E and 3A-3B. The deflector 112 may contact against and be supported by the angled section of the extension arm 118 at the second end 128. Each of the angled section and the rear of the deflector 112 may be flat to provide adequate contact and support. Alternatively, the deflector 112 is attached along an intermediate portion of the arm 118 between the ends 126, 128. The deflector 112 may be attached in a variety of different manners, including but not limited to one or more mechanical fasteners and welding.

The deflector 112 includes an enlarged surface area that faces away from the extension arm 118 and is configured to deflect oncoming water during normal operation. The surface area may include a rectangular shape, although other shapes may also be used with each including a length and a width. The deflector 112 includes a first section 140 having a leading end 136 and a second section 141 having a trailing end 138 opposing the leading end 136. As illustrated in FIGS. 2A-2B, 2E and 3A-3B, the leading end 136 is positioned in front of the end 122 of the base 116, while the trailing end 138 is positioned over the base 116. When the device 100 is mounted on the side 102 of the watercraft 104, the leading end 136 is proximately located the side 102 of the watercraft 104 and the trailing end 138 is positioned away from the side 102 of the watercraft 104. The leading end 136 may be aligned with the base 116, or may be positioned farther from or closer to the watercraft 104 during attachment (e.g., FIGS. 2A-2B, 2E and 3A-3B include the leading end 136 positioned closer to the boat 104 than the base 116).

In some preferred aspects, the first section 140 of deflector 112 is operable attached to the second section 141 by one or more hinges 170. In certain preferred aspects, the first section 140 has a distal end that operably engages with a proximate end of the second section 141 to form one or more integral hinges 170 having one or more rods running through a longitudinal axis of each integral hinge 170. In some alternative aspects, a hinge 170 is proximately located on the backside of the deflector 112, whereby the hinge is attached to the first and second sections 140, 141 in various manners including but not limited to welding and mechanical fasteners.

The one or more hinges 170 allow the second section 141 to rotatably swivel with respect to the first section 140 in a folding mechanism. The folding mechanism of deflector 112 allows the device 100 to be folded, such that the overall size of the device 100 can have a smaller configuration for storage when not being used, as storage space on a watercraft 102 can be a premium.

Figure 2B:
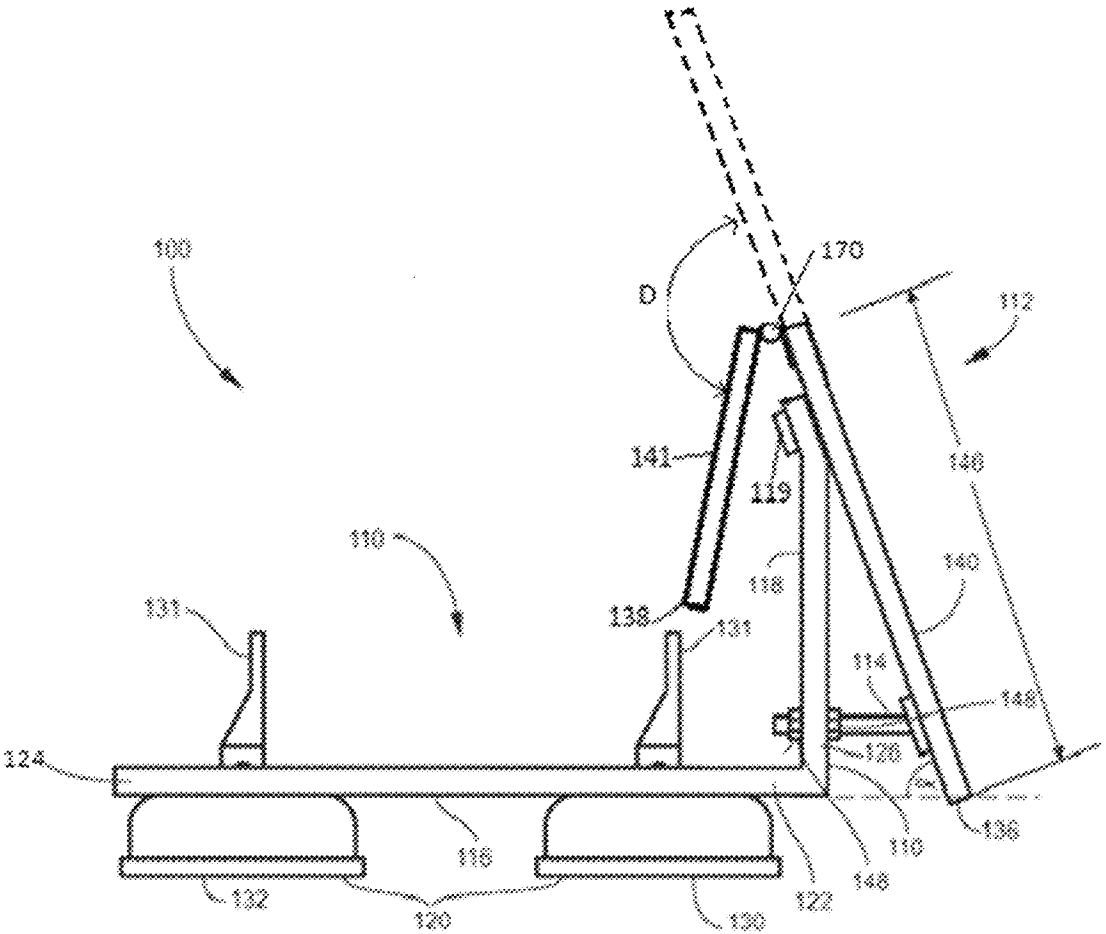
FIG. 2B is a side view of the water flow deflection device of FIG. 2A with the water flow deflector in a folded position, according to certain embodiments of the present invention.
Figure 2D:
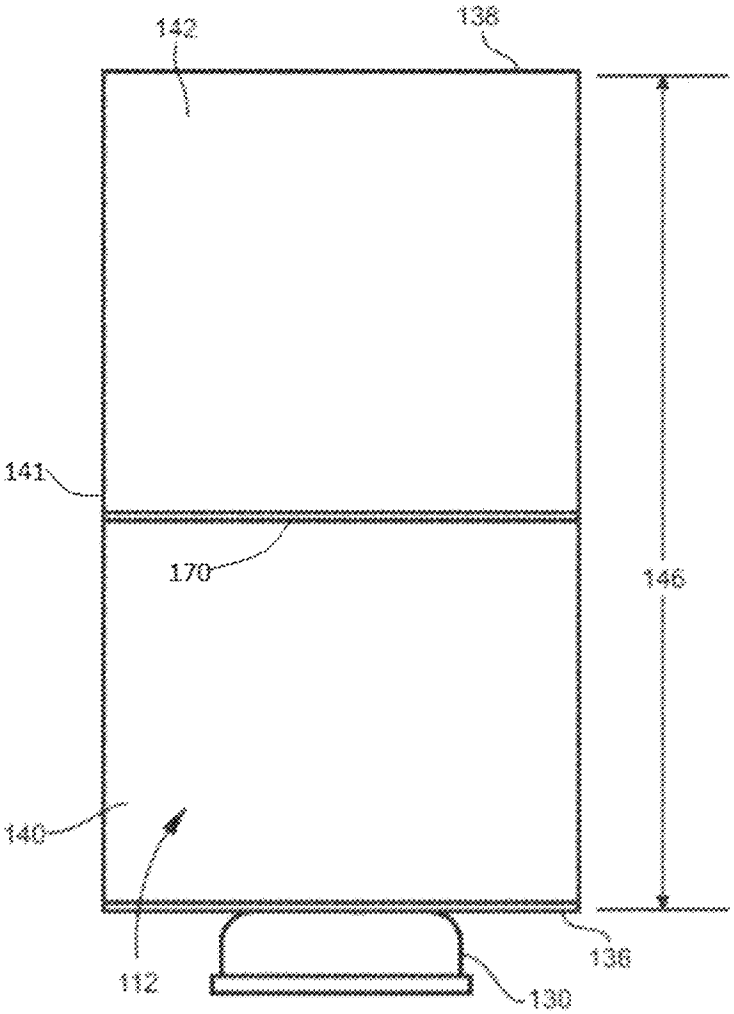
FIG. 2D is a front view of the water flow deflection device of FIG. 2A, according to certain embodiments of the present invention.

In certain preferred aspects, the second section 141 is foldable with respect to the first section 140, such that the deflector 112 is capable of being rotatably adjusted between a fully extended position and a folded position. As shown in FIG. 2B, second section 141 can rotatably swivel along the longitudinal axis of the hinge at angle D. In some aspects, angle D can be between 0 degrees (dotted line in fully extended position) and about 180 degrees (folded). As best shown in FIGS. 2A, 2E, 3A and 4 of deflector 112 in the fully extended position, deflector 112 has a greater length 146 in the fully extended position than the folded position, which is best shown in FIGS. 2B and 3B.

In some aspects, deflector 112 is adjusted to the fully extended position during normal operation, such that deflector 112 in the fully extended position operably engages with oncoming water to enhance the water flow deflection 100 as watercraft 104 moves through the water and thereby enhancement of wake formation behind watercraft 104. In some aspects, deflector 112 is adjusted to the folded position for storage, such as when the device 100 is removed from the side 102 of watercraft 104.

Deflector 112 is also capable of being positioned at an intermediate position along angle D during normal operation, whereby the second section 141 is adjusted to a position between the fully extended position and the folded the position. For instance, as shown in FIG. 3B, deflector 112 may be rotatably adjusted at an intermediate position, such that section 141 in the intermediate position is still capable of operably engaging with oncoming water to enhance the water flow deflection as the watercraft 104 moves through the water and thereby enhancement of wake formation behind the watercraft 104. In some aspects, intermediate position is greater than 0 degrees (fully extended position) and less than about 180 degrees, in some aspects less than about 175 degrees, in some aspects less than about 170 degrees, in some aspects less than about 165 degrees, in some aspects less than about 160 degrees, in some aspects less than about 155 degrees, in some aspects less than about 150 degrees, in some aspects less than about 145 degrees, in some aspects less than about 140 degrees, as the ability of second section 141 to fully fold back can be dependent upon the interaction of second section 141 and arm 118 and/or second end 128. In the intermediate position, trailing end 138 of deflector 112 is moved closer to base 116 than when second section 141 is in the fully extended position.

In certain preferably aspects, second section 141 can be locked into the fully extended, an intermediate position, or the folded position with respect to first section 140. In some aspects, a fastening means can lock second section 141 into the desired position with respect to first section 140.

Figure 2C:
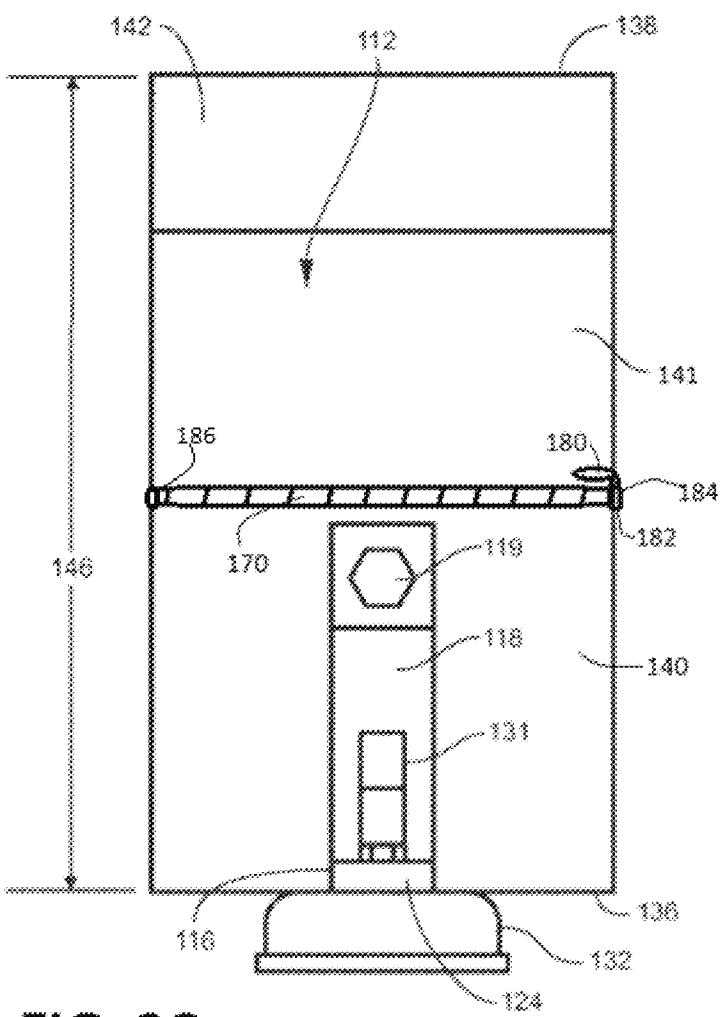
FIG. 2C is a rear view of a water flow deflection device of FIG. 2A, according to certain embodiments of the present invention.
Figure 2E:
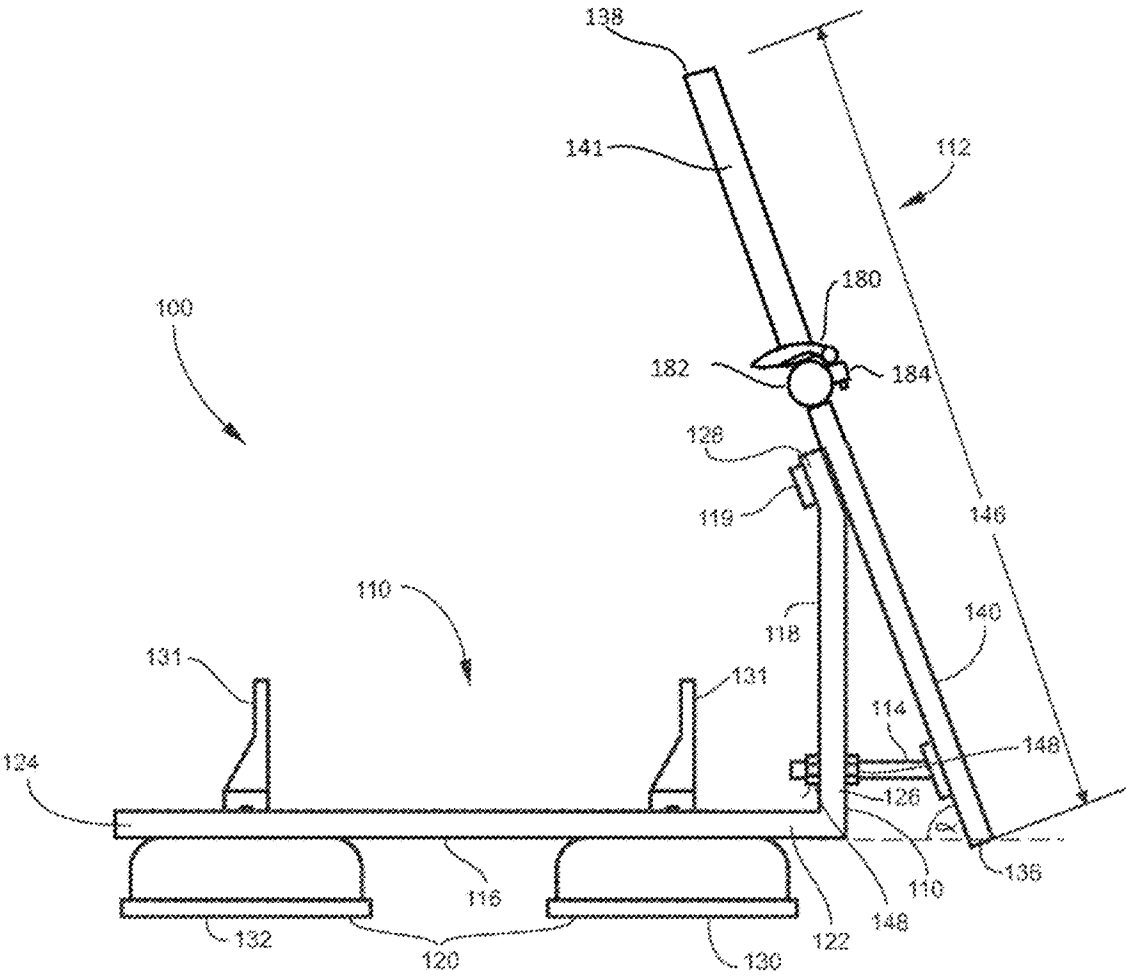
FIG. 2E is a side view of a water flow deflection device of FIG. 2A with a lever operated cam assembly located on the opposite end of the deflector, according to certain embodiments of the present invention.
Figure 3A:
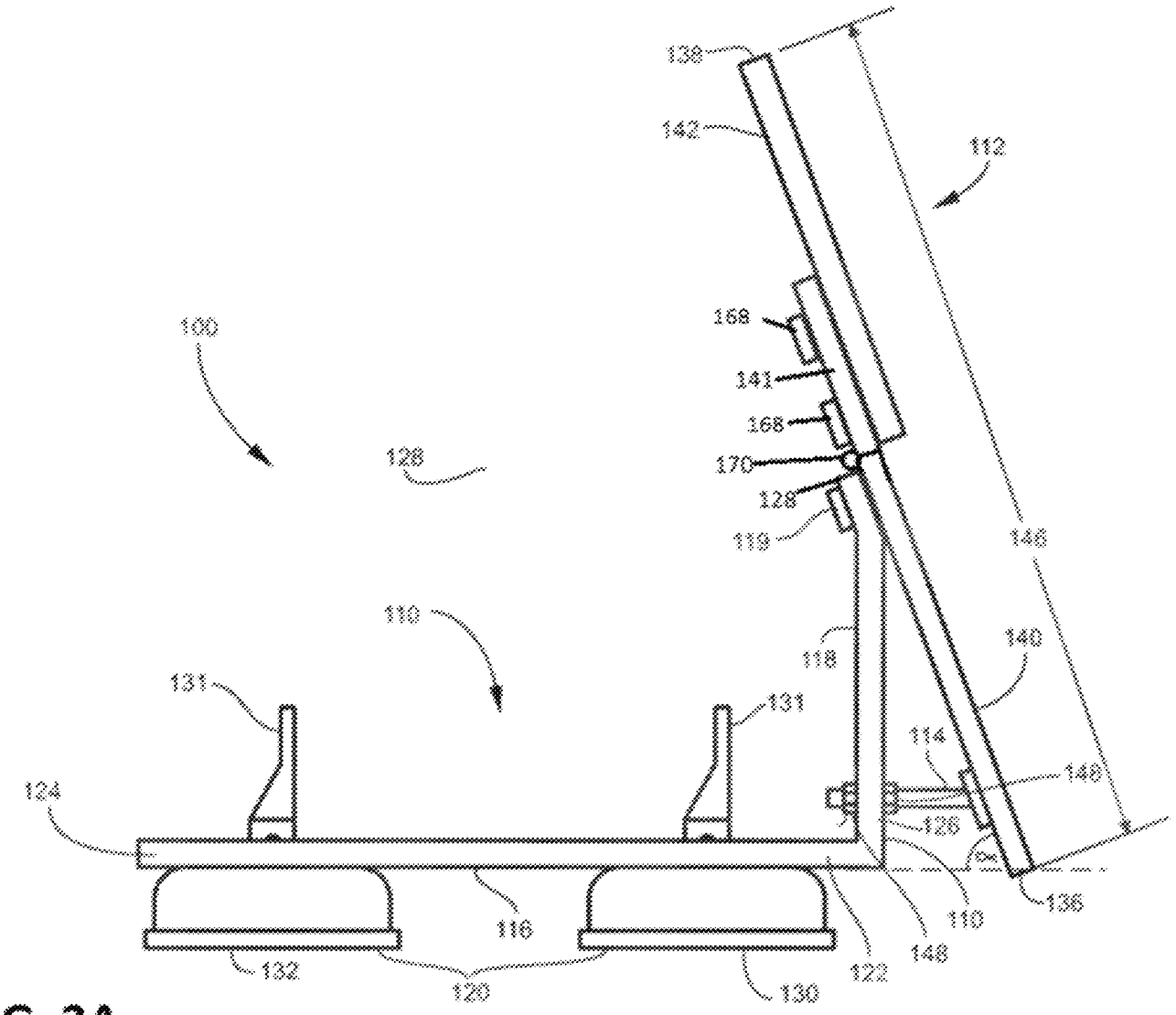
FIG. 3A is a side view of a water flow deflection device to be attached to the side of a watercraft, the water flow deflector in a fully extended position and an extension section in an fully extended position, according to certain embodiments of the present invention.
Figure 3B:
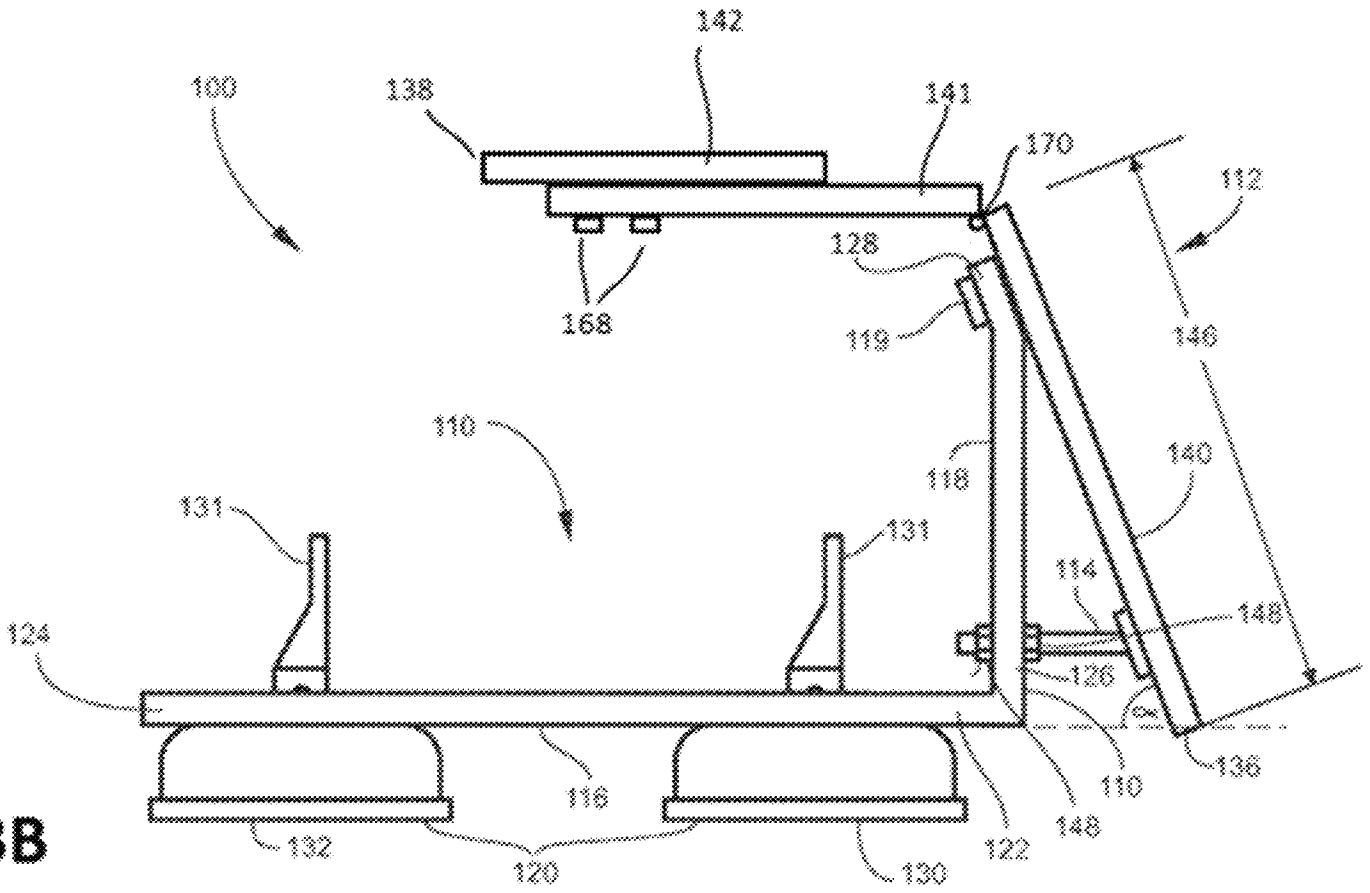
FIG. 3B is a side view of the water flow deflection device of FIG. 3A with the water flow deflector in a folded position and the extension section in a retracted position, according to certain embodiments of the present invention.
Figure 10:
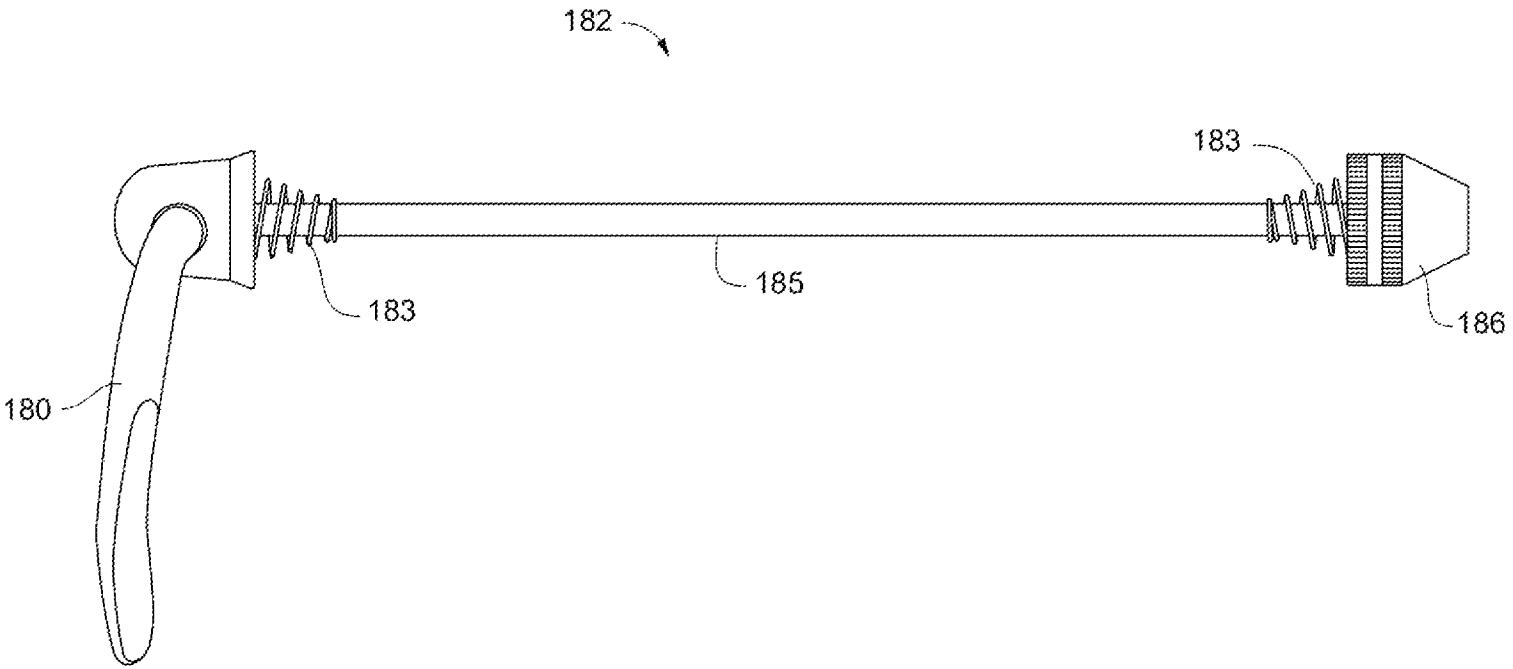
FIG. 10 is a schematic of a quick release skewer assembly for fastening the first and second sections of the deflector of a water flow deflection device, according to certain embodiments of the present invention.

In certain preferred aspects, the fastening means is a quick release skewer assembly 182, as shown in FIGS. 2C, 2E and 10. Quick release skewer assembly has a rod 185 threaded on one end that is operably inserted through the apertures of the hinge 170 in the longitudinal axis and a lever operated cam assembly 184 on the other end, whereby an adjustment nut 186 operably engages the threaded end of rod 185 at an opposite end of the lever operated cam assembly 184. Quick release skewer assembly optionally has two or more conical springs 183. In certain aspects, conical springs 183 press against the ends of the hinge 170 and are compressed as the lever operated cam assembly 184 is tightened with respect to the adjustment nut 186. The quick release skewer assembly 182 can be used with hinge 170 such that the lever 180 of the lever operated cam assembly 184 can be folded on the backside of deflector 112 in the fastened position, such oncoming water during normal operation does interact with and release lever 180 from a fastened position. Alternatively, lever 180 of the lever operated cam assembly 184 can be folded on the frontside of deflector 112 in the fastened position such that lever 180 touches or almost touches the face of deflector 112, such that oncoming water can only further tighten lever 180 or push it to touch the face of deflector 112 in the fastened position.

The fastening means can also comprise one or more bars 190 proximately located the backside of deflector 112, the one or more bars 190 slidable between a locked position and an unlocked position. In the locked position, bars 190 extend above first section 140 to operable engage with second section 141 and preventing second section 141 from rotatably swiveling along the longitudinal axis of hinge 170, such that second section 141 is incapable of folding during normal operation when oncoming water operably engages deflector 112. In the unlocked position, second section 141 is capable of rotatably swiveling along the longitudinal axis of hinge 170 and being rotated to the folded position. Second section 141 can be locked into the folded position.

In some preferred aspects, second section 141 is about 50% or less of the total surface area of deflector 112, such that first section 140 is about 50% or greater of the total surface area of deflector 112. In some aspects, second section 141 is between about 10% and about 50% and first section is between about 50% and 90% of the total surface area of deflector 112 in the fully extended position.

Besides deflector 112 being capable of being folded, deflector 112 can also have an adjustable extension to provide the desired surface area of deflector 112 for wake shaping. As illustrated in both FIGS. 3A-3D, deflector 112 includes a first section 140, second section 141 and extendible section 142. Second section 141 and extendible section 142 are in an overlapping configuration, with extendible section 142 capable of sliding between a fully extended position and a fully retracted position, with intermediate extended positions there between. In the illustrated embodiment, extendible section 142 is positioned over second section 141. Other embodiments may include the extendible section 142 behind the second section 140.

Figure 3D:
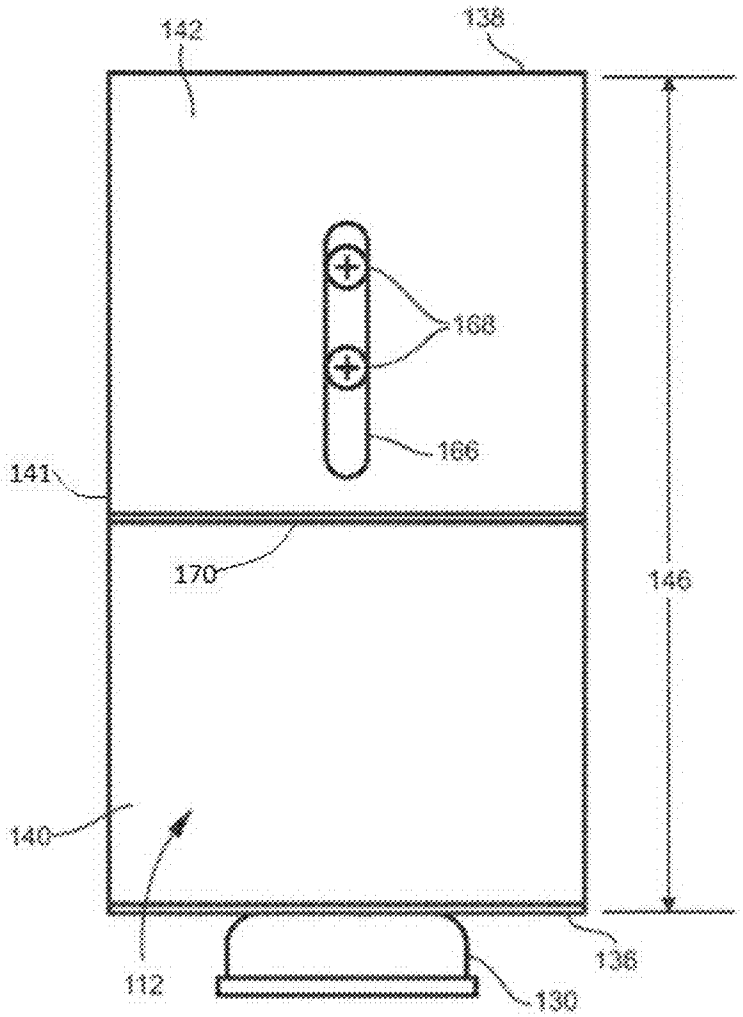
FIG. 3D is a front view of the water flow deflection device of FIG. 3A, according to certain embodiments of the present invention.

In one embodiment, one or more fasteners 119 fixedly attach first section 140 to the extension arm 118. Extendible section 142 is then movably attached to second section 141 of the deflector 112. In one embodiment, as shown in FIG. 3D, one or both sections 141, 142 includes a slot 166 that extends along at least a portion of its length. One or more fasteners 168 are positioned in the slot(s) 166 and provide for movable placement of one section relative to the other section 141, 142.

In the embodiment of FIGS. 3A-3D, just extendible section 142 includes a slot 166 with the fasteners 168 connected to the back second section 141 and extending through the slot 166. By loosening the fasteners 168, the extendible section 142 may be slid relative to the second section 141 to adjust a size of the surface area that is exposed. Once positioned, the fasteners 168 are tightened to secure the relative positions of the sections 141, 142. Rails, grooves, or other structures may be positioned on one or both sections 141, 142 to further facilitate the relative motion and to maintain the relative orientation of the sections 141, 142. In some aspects, extendible section 142 may overlap with first section 140 in the fully retracted position.

In certain preferred aspects, first section 140 of deflector 112 may be fixedly attached to the extension arm 118. This provides for the foldable second section 141 to be rotatably adjusted between the fully extended position and any intermediate position up to the folded position. This also provides extendible section 142 of deflector 112 to be moveable in front of and supported by second section 141. This provides additional support for the extendible section 142 when the device 100 is in use and be acted upon by the water. The force of the water acting on the extendible section 142 maintains its position against the back second section 141.

The size of the deflector 112 is adjustable not only on the folded position of second section 141 with respect to first section 141 but also based on the relative positioning of the extendible section 141 with respect to second section 141. The overall size of the deflector 112 is formed by the amount of exposed area of each of the sections 140, 141, 142. The deflector 112 will have the largest surface area when second section 141 is in the fully extended position with respect to first section 140 and extendible section 142 has the least overlap with second section 141 and are slid apart. Likewise, deflector 112 will the smallest surface area when second section 141 is in the fully folded position with respect to first section 140 and extendible section 142 has enough overlap with second section 141 and are slid together such that second section 141 and extendible section 142 do not operably engage with oncoming water when the watercraft 104 is going through the water, but only first section 141 operably engages with oncoming water. Accordingly, the amount of surface area of deflector 112 can be adjusted to various different surface areas, with the desired surface area for wake shaping being adjusted based upon the folded position of second section 141 and the extended position of extendible section 142.

Figure 3C:
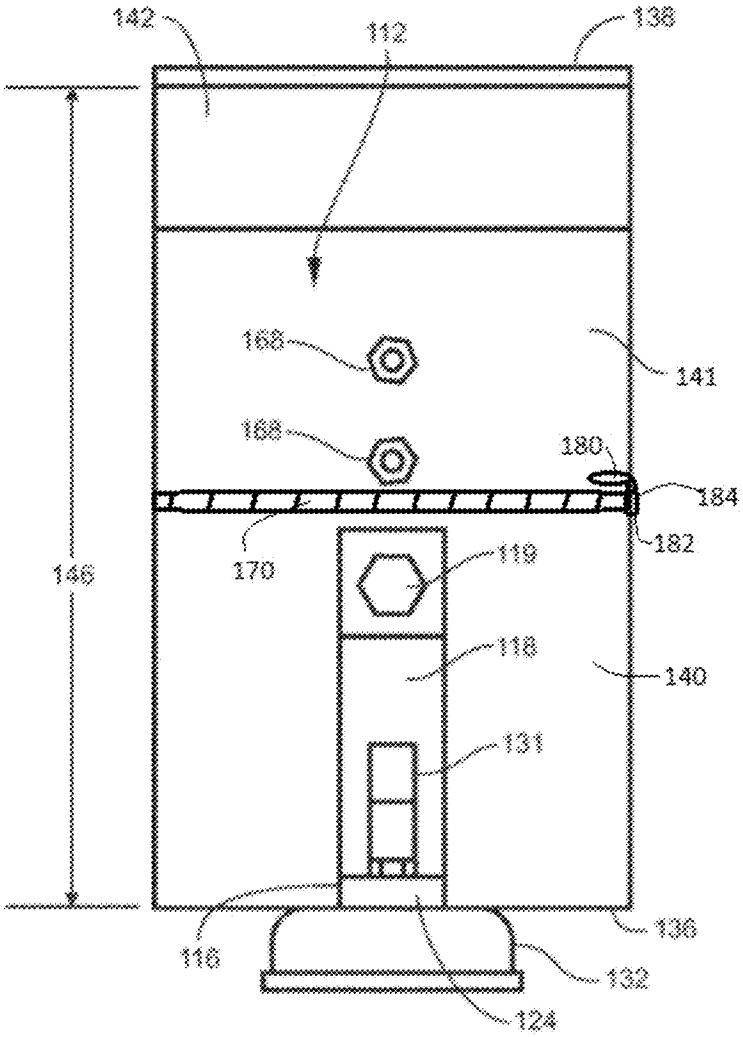
FIG. 3C is a rear view of a water flow deflection device of FIG. 3A, according to certain embodiments of the present invention.
Figure 4:
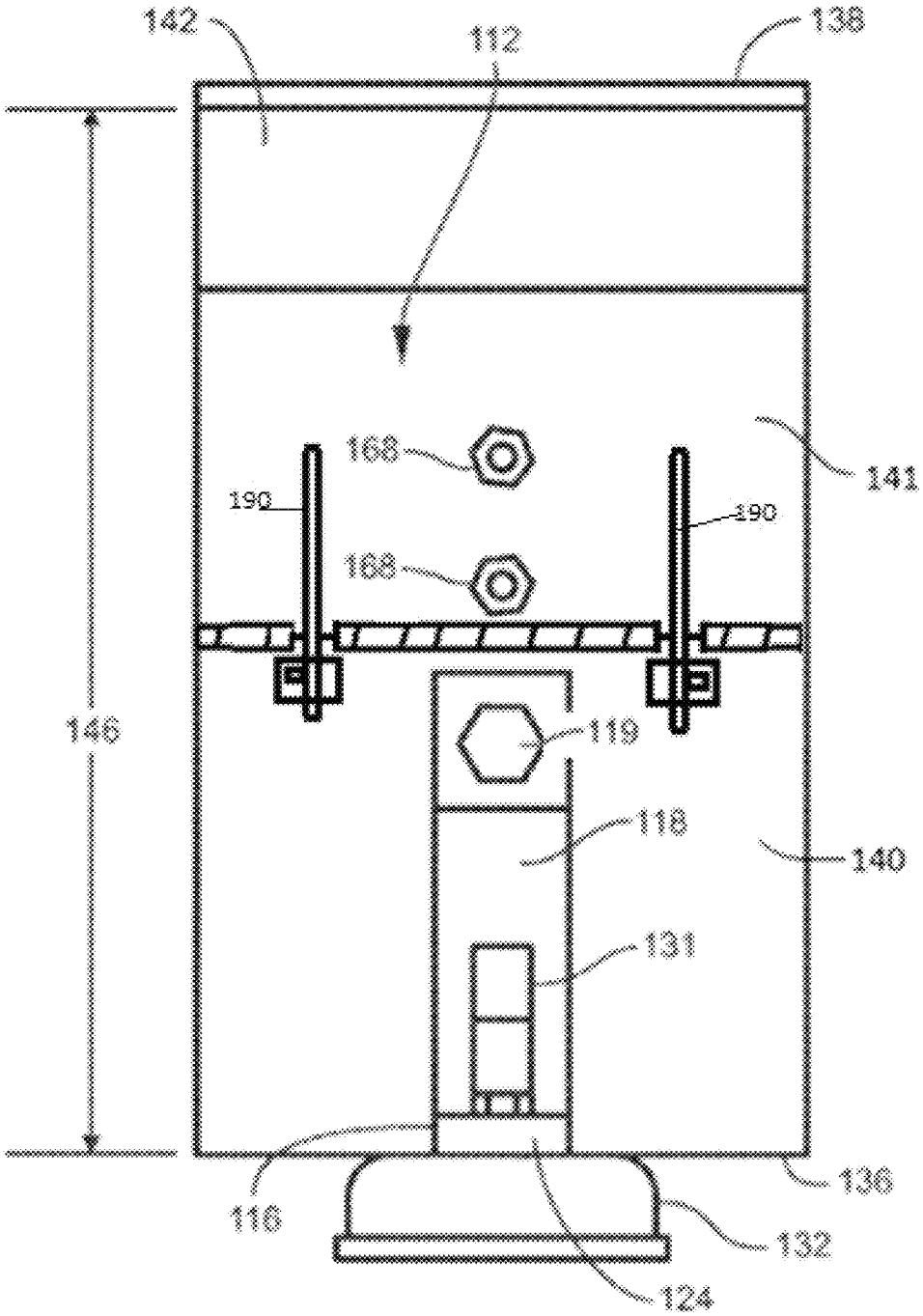
FIG. 4 is a rear view of a water flow deflection device with locking pins maintaining the water flow deflector in a fully extended position, according to certain embodiments of the present invention.

In one embodiment, second section 141 and extendible section 142 are adjustable along one dimension. As shown in FIGS. 3C and 3D, sections 141, 142 are movable in one dimension to adjust length 146 measured between the leading end 136 and the trailing end 138. In the embodiment of FIGS. 3C and 3D, the extendible section 142 may be repositioned relative to the second section 141 by sliding the extendible section 142 over the second section 141 and adjusting the length 146. As the length 146 measured between the leading end 136 and the trailing end 138 is increased, the size of the enlarged surface area 134 increases. In a similar fashion, the extendible section 142 may be slid back over the second section 140 so as to decrease the length 146 and the surface area 134. The deflector 112 may have various sizes depending upon the need. In some embodiments, deflector 112 with extendible section 142 has an adjustable surface area between 40 to 140 square inches.

The deflector 112 may also be configured to provide for adjustment along two dimensions, such as to adjust a length and a width.

Figure 5:
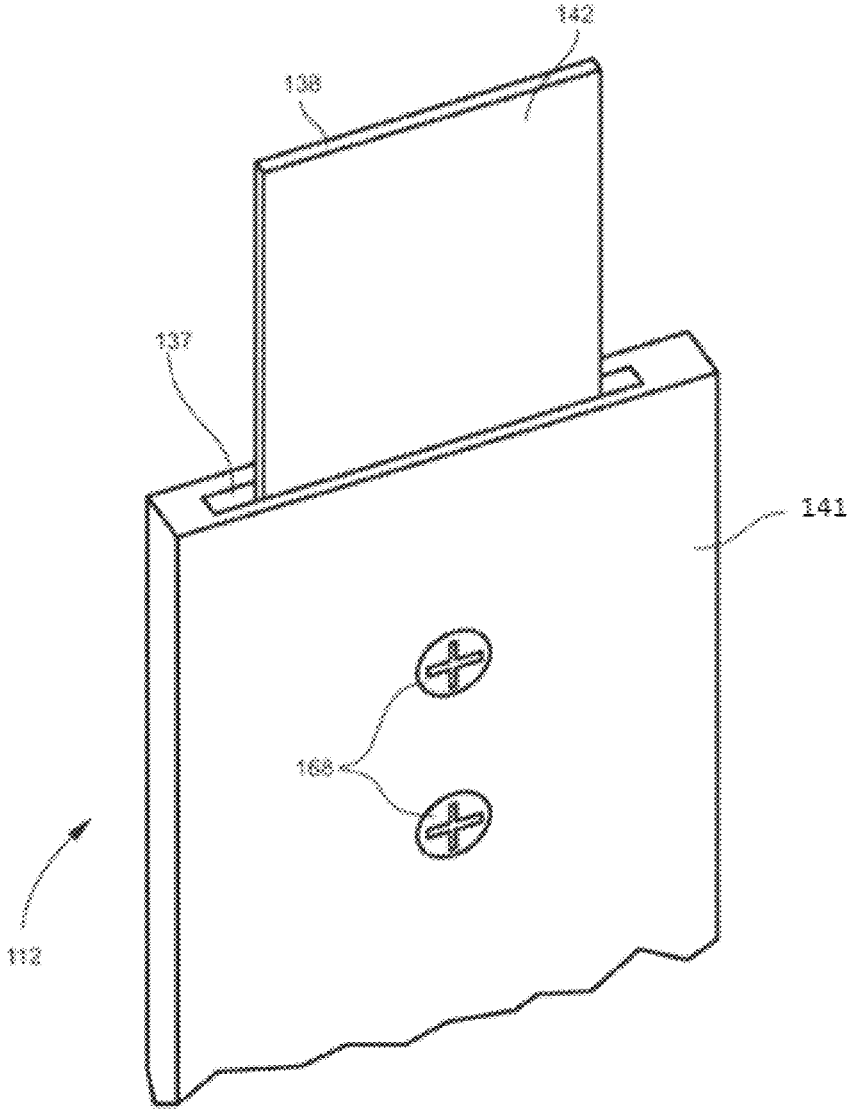
FIG. 5 is a partial perspective view of a water flow deflector, according to certain embodiments of the present invention.

As illustrated in FIG. 5, the deflector 112 may also include the extendible section 142 positioned within a pocket 137 formed in the interior of the second section 141. The extendible section 142 may be adjusted to the desired positioned relative to the second section 141 and secured in position by one or more fasteners 168. In the embodiment of FIG. 5, the extendible section 142 includes a slot (not illustrated) sized to receive the fasteners 168 and provide for the selective positioning.

Second section 141 and extendible section 142 may include the same shapes and sizes. For example, the embodiment of FIGS. 3A-3D includes sections 140, 141, 142 having a common width. FIG. 5 includes the extendible section 142 having a smaller width than the second section 141.

The angle α of the deflector 112 relative to the base 116 can also be adjustable. As illustrated in FIGS. 2A and 2B, a support 114 extends between and connects the deflector 112 to the extension 118. As illustrated, the angle α is formed between an extension of the base 116 and the deflector 112.

The support 114 is connected to the same section of the deflector as the extension arm 118. In one embodiment as illustrated in FIGS. 2A and 2B, this includes connection to the first section 140. This allows for the second section 141 to remain foldable and extendible section 142 to be movable to adjust the overall size of the deflector 112. The deflector 112 is attached to the extension arm 118 to allow for adjusting the angle α. In one embodiment, this may include the mechanical fastener 119 loosely connecting the extension arm 118 to the deflector 112 thus allow for movement. This may also include the extension arm 118 being flexible to allow for changing the angle α.

The support 114 may be a threaded member such as a bolt with one or more adjustable securing members 148. The securing members 148 may be configured to allow a user to hand tighten or loosen the member 148 to adjust the angle α. In one embodiment, the securing members 148 may be wing nuts, knobs, or bolts. The securing member 148 may be configured so as to be affixed on one or both sides of the extension arm 118. For example, in some embodiments only one securing member 148 may be required in order to provide for adjustment, while other embodiments as illustrated in FIGS. 2A and 2B include a securing member 148 on each side of the extension arm 118.

The water flow deflection device 100 may be configured such that it is buoyant, causing the water flow deflection device 100 to float in water when detached from the watercraft 104. The buoyancy may be a result of one or more sections of the frame 110 being hollow. The water flow deflection device 100 may also be configured with a leash that is attachable to the watercraft 104.

Figure 6:
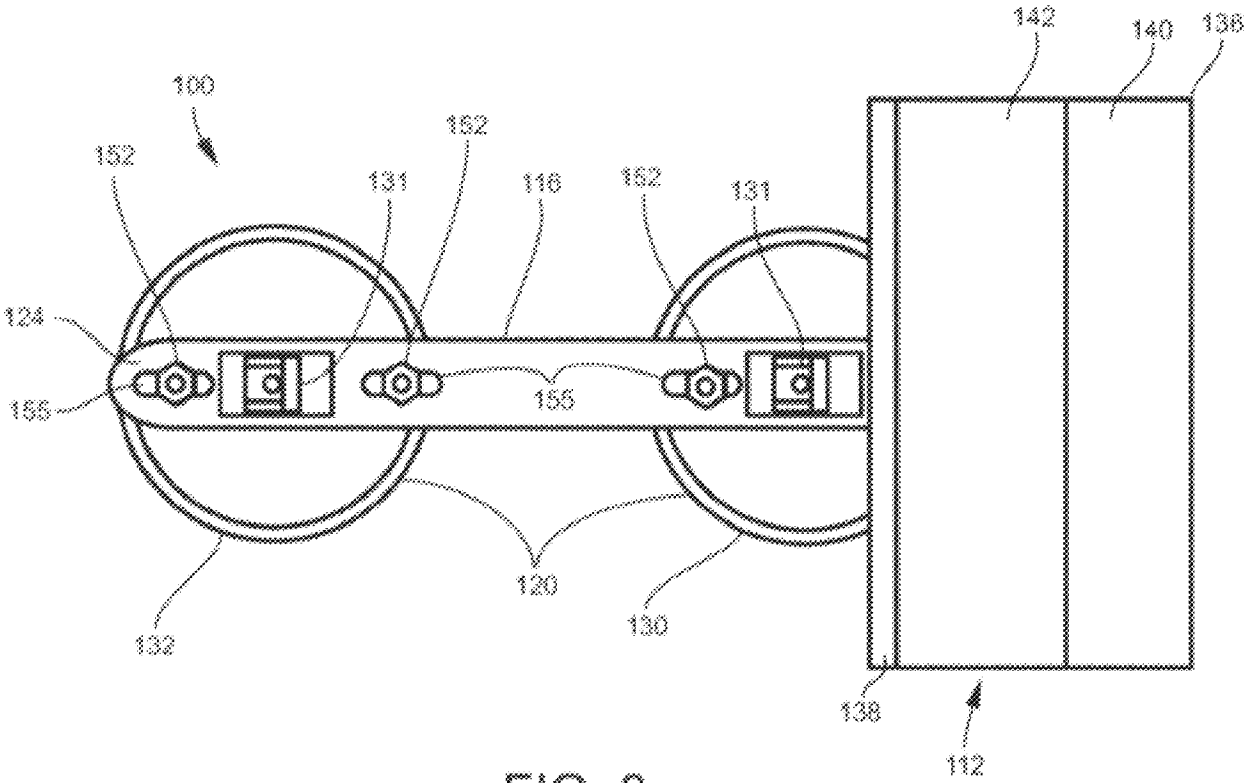
FIG. 6 is a top view of a water flow deflection device, according to certain embodiments of the present invention.

FIG. 6 is a top view of the water flow deflection device 100. In this embodiment, the suction cups 120 are attached to the base 116 by attachment members 152. The positioning of the suction cups 120 along the base 116 may be adjusted by loosening the attachment members 152, sliding the suction cups 120 along the adjusting slots 155 formed in the base 116, and securing the attachment members 152. By adjusting the position of the suction cups 120 on the base 116, the suctions cups 120 can be aligned with the desired sections of the boat 102 to provide for a secure attachment. The length of the elongated base 116 and the length of the adjusting slots 155 may vary as desired to provide the necessary adjustment for positioning the suction cups 120 over a substantially smooth portion of the side 102 of the boat 104. For example, the length of the elongated base 116 may be up to 4 feet. The adjusting slots 155 may be variably sized so as to accommodate the release 131.

Figure 7:
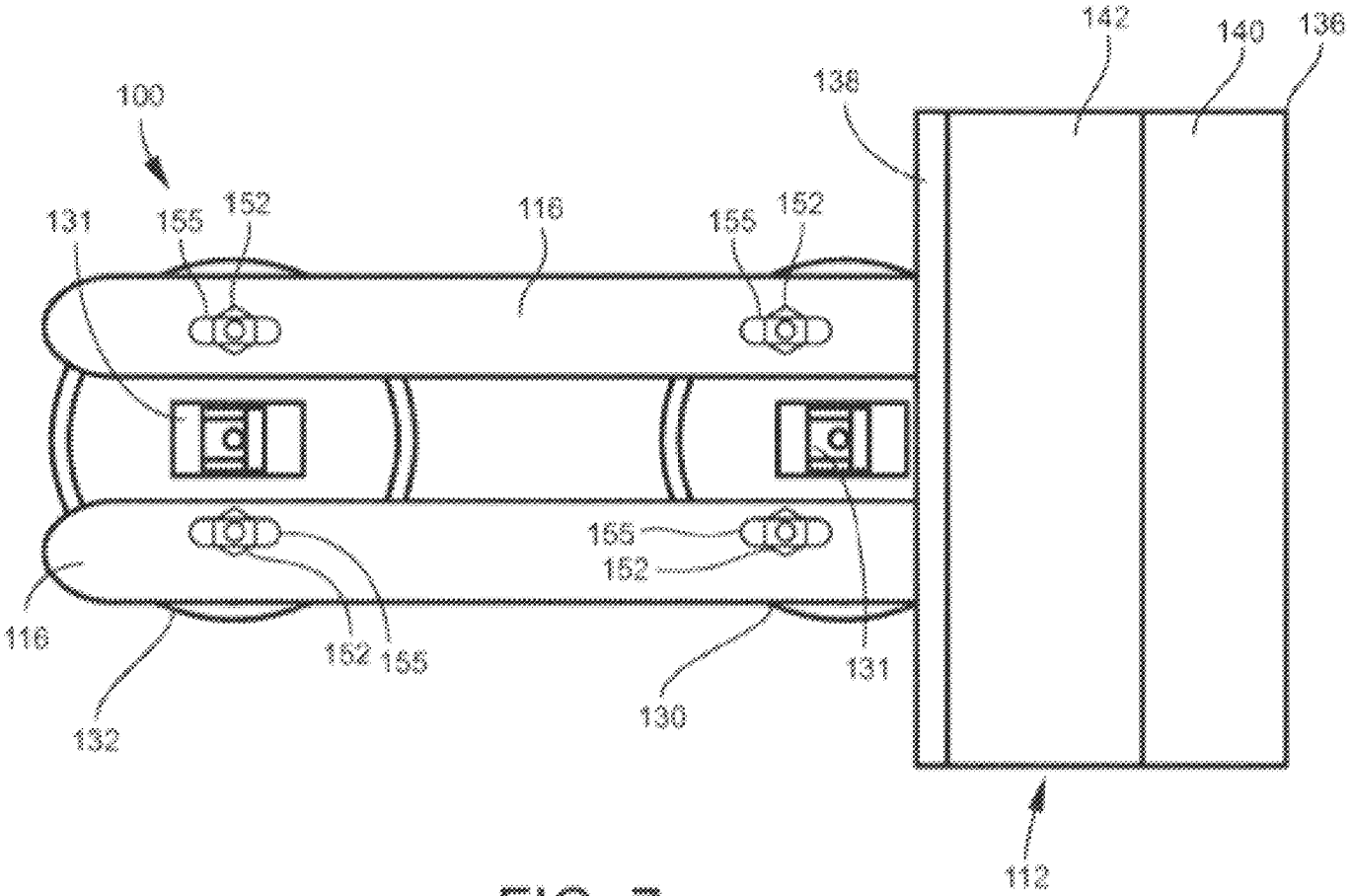
FIG. 7 is a top view of a water flow deflection device, according to certain embodiments of the present invention.

In an alternative configuration as illustrated in FIG. 7, the base 116 is formed by two separate members. The members are each straight and aligned in a side-by-side and parallel orientation. Suctions cups 130, 132 are movably attached to the members via elongated slots 155 equipped with fasteners 152. In this embodiment, the extension arm 118 (not illustrated in FIG. 7) may be formed by two separate members in a side-by-side and parallel orientation. In one embodiment, the frame 110 is constructed from two separate members that each includes a base 116 and extension arm 118. Each member may have the same appearance as that illustrated in FIGS. 2A and 2B.

Figure 8:
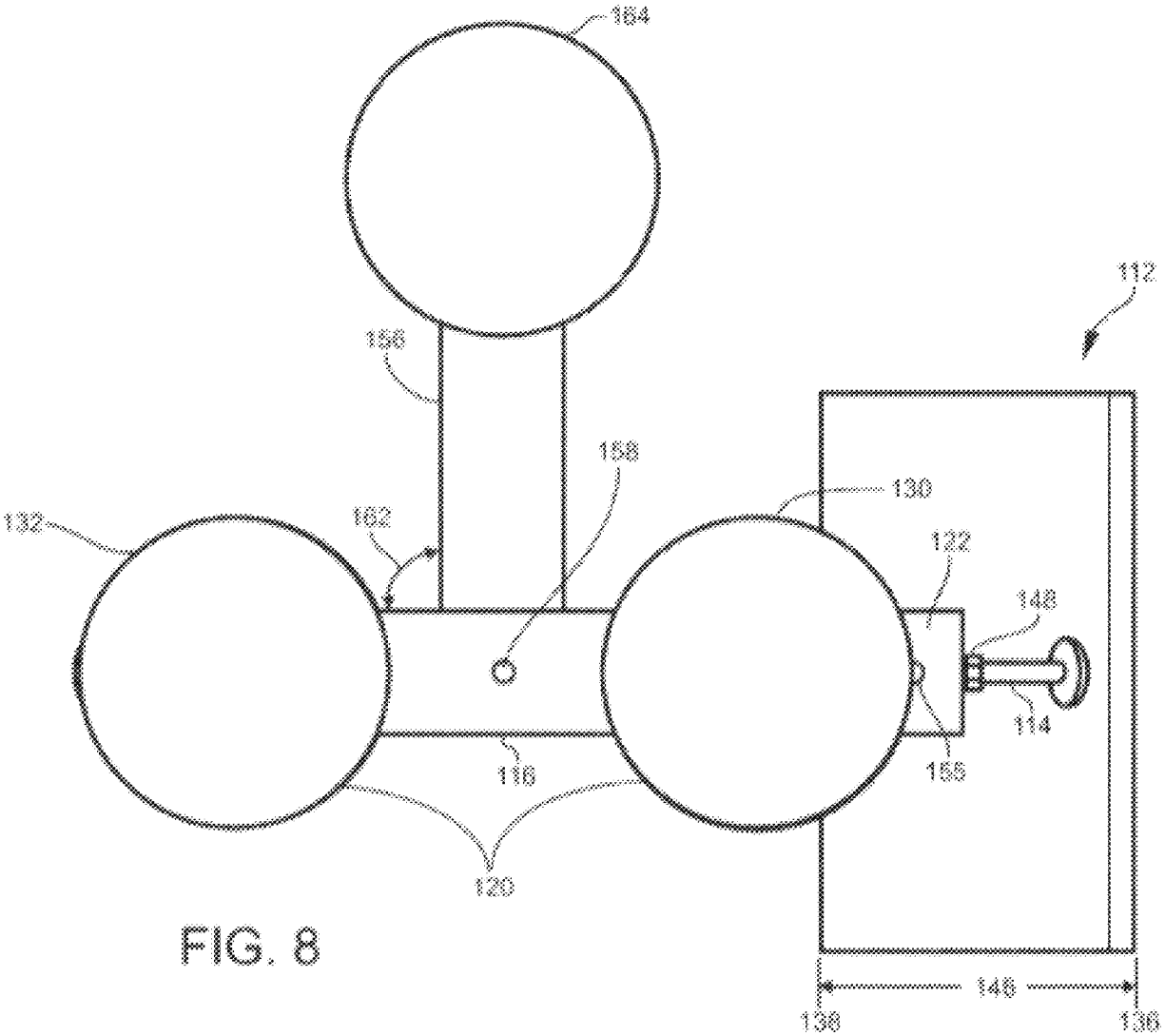
FIG. 8 is a bottom view of a water flow deflection device, according to certain embodiments of the present invention.

FIG. 8 illustrates an embodiment that includes an arm 156 connected to the base 116. The arm 156 is attached along an intermediate section of the base 116 between the suction cups 130, 132. The arm 156 is attached in a manner to be positioned at a desired angle 62 relative to the base 116. In one embodiment, the end of the arm 156 is connected with a mechanical fastener 158 to the base 116. This provides for pivoting movement of the arm about the fastener 158 to the desired angular position. The fastener 158 may be tightened when the arm 156 is at the desired orientation to lock the position. A suction cup 164 is attached to the arm 156 proximate to extended end.

Figure 9:
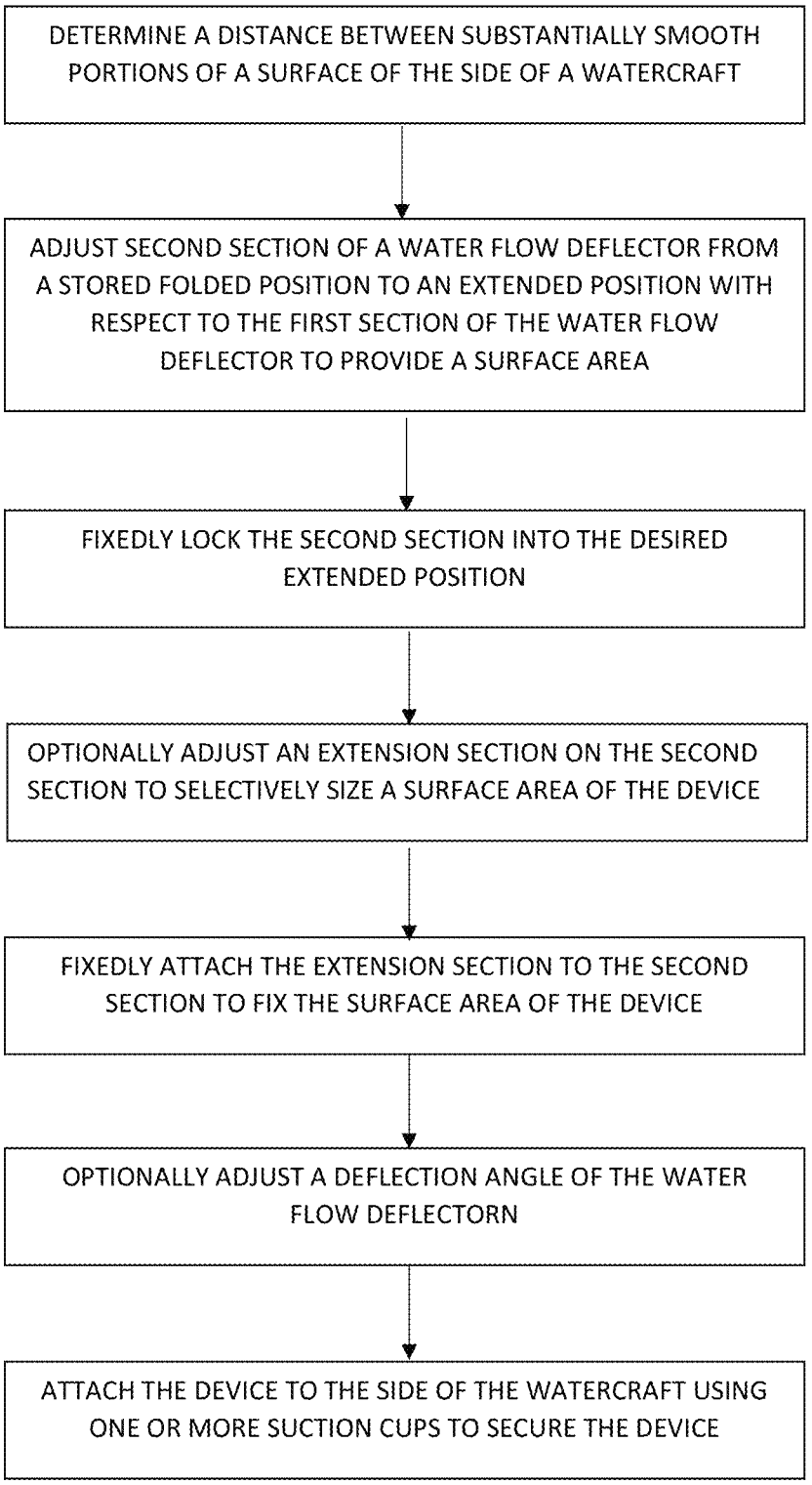
FIG. 9 is a flow chart of a method of use of a water flow deflection device, according to certain embodiments of the present invention.

A method of use of the water flow deflection device 100 is illustrated in FIG. 9. The method includes determining a distance between substantially smooth portions of a surface of the side of a watercraft. A substantially smooth portion of the surface of the side of the watercraft may be a surface that does not have decals or dimensioned labelling. The method also includes optionally adjusting the distance between two or more suction cups affixed to the base of the water flow deflection device. The suction cups are adjusted such that the distance between the suction cups is equal to the distance between the substantially smooth portions of the side of the boat. The method also includes adjusting first and second sections of a water flow deflector to selectively size a surface area. The deflector is operatively connected to the suction cups and includes a leading end and the opposing trailing end. The leading end is proximate to the side of the boat and the trailing end extending away from the side of the boat when the device is attached to the side of the boat. Adjusting the first and second sections changes a distance between the leading end and the trailing end. The second section can be adjustably locked into a fully extended position or an intermediate position with respect to the first section. The method also includes optionally adjusting an extension section with respect to the second section of a water flow deflector to selectively size a surface area. The method also includes fixedly attaching the extendible section and the second section together to fix the surface area. The method also includes optionally adjusting a deflection angle of the water flow deflector. Once these adjustments are made, the device can then be attached to the side of watercraft for use, whereby the attachment occurs by the one or more suction cups. The adjustment of the second section with respect to the first section and/or the extendible section with respect to the second section can be done after the device is attached to the side of the watercraft. The deflection angle can also be adjusted once the device is attached to the side of the watercraft.

Some of the adjustments may occur prior to attachment to the boat. Alternatively, some or all of the adjustments may occur after the device is attached to the boat.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

What is claimed is:

1. A water flow deflection device configured to be attached to a side of a watercraft for the enhancement of a wake, the water flow deflection device comprising:

a frame comprising an elongated base with a first end and a second end, the elongated base configured to be aligned along the side of the watercraft when the water flow deflection device is attached to a side of the watercraft;

an extension arm attached to and extending outwardly from the elongated base, the extension arm having a first end and a second end, the extension arm extending away from the side of the watercraft when the water flow deflection device is attached to the side of the watercraft;

two or more suction cups attached to the elongated base, a first suction cup attached to the elongated base proximate to the first end and a second suction cup attached to the elongated base proximate to the second end; and a water flow deflector attached to the first end of the extension arm and being aligned at an acute angle relative to the elongated base, the deflector comprising an enlarged surface area configured to deflect water and having a leading end that is positioned outward in front of the elongated base and a trailing end opposing the leading end, the leading end being in closer proximity to the boat than the trailing end when the deflector is attached to the side of the watercraft, the deflector comprising a first section and a second section, the first section attached to the extension arm and the second section being rotatably adjustable with respect to the first section between a fully extended position and a folded position, such that the distance between the leading end and the trailing end and the surface area that is exposed are adjustable.

2. The water flow deflection device of claim 1, wherein the first and second sections are operably engaged by a hinge.

3. The water flow deflection device of claim 1, further comprising a support that extends between and connects the deflector to the extension arm, the support configured to adjust the angle of the deflector relative to the extension arm.

4. The water flow deflection device of claim 1, wherein the first section of the deflector is attached to the first end of the extension arm.

5. The water flow deflection device of claim 1, wherein the deflector further comprises an extendible section moveable relative to the second section to adjust the distance between the leading end and the trailing end, such that the surface areas that is exposed is adjustable.

6. The water flow deflection device of claim 5, wherein the second and extendible sections of the deflector are in an overlapping configuration with a first portion of the second section overlapping with a second portion of the extendible section.

7. The water flow deflection device of claim 5, wherein the extendible section of the deflector is positioned within the second section and is extendable from within the second section.

8. The water flow deflection device of claim 1, wherein the elongated base comprises first and second elongated members that are arranged in a side-by-side arrangement with the first member being parallel to the second member, the extension arm being connected to at least one of the elongated members.

9. The water flow deflection device of claim 1, wherein the water flow deflection device is buoyant causing the water flow deflection device to float in water when detached from the watercraft.

10. The water flow deflection device of claim 1, wherein the frame further comprises a second extension arm having a first end attached to the elongated base and an opposing second end extending away from the elongated base, a third suction cup attached to the second extension arm, and the second extension arm being angularly adjustable relative to the elongated base to position the third suction cup at a desired location relative to the elongated base.

11. The water flow deflection device of claim 1, wherein the second end of the elongated base is connected to the second end of the extension arm.

12. The water flow deflection device of claim 1, wherein the second section is capable of being configured into an intermediate position between the fully extended position and the folded position during normal operation.

13. The water flow deflection device of claim 1, wherein the first section has a distal end that operably engages with a proximate end of the second section to form an integral hinge, wherein the integral hinge is capable of having one or more rods running through a longitudinal axis of the integral hinge.

14. The water flow deflection device of claim 1, wherein the first section and second section are capable of being locked into the fully extended position, the folded position or an intermediate position by a fastening means.

15. The water flow deflection device of claim 1, wherein the fastening means is a quick release skewer assembly.

16. The water flow deflection device of claim 1, wherein the first section and second section are capable of being locked into the fully extended position by or one or more slidable bars.

17. The water flow deflection device of claim 16, wherein the one or more slidable bars operably engage a backside of the second section in the fully extended position, the backside defined as the side of the deflector opposite a frontside, whereby the frontside operably engages oncoming water during normal operation.

18. The water flow deflection device of claim 1, wherein the second section is about 50% or less and the first section is about 50% or greater of the total surface area of deflector.

19. The water flow deflection device of claim 1, wherein the second section is between about 10% and about 50% and first section is between about 50% and 90% of the total surface area of deflector in the fully extended position.

20. The water flow deflection device of claim 1, wherein the second section is capable of being locked in the folded position.

* * * * *